US007584578B2

(12) United States Patent
Hilmy

(10) Patent No.: US 7,584,578 B2
(45) Date of Patent: Sep. 8, 2009

(54) SEISMIC ENERGY DAMPING APPARATUS

(76) Inventor: Said I. Hilmy, 1 Peters Canyon Rd., Suite 140, Irvine, CA (US) 92606

( * ) Notice: Subject to any disclaimer, the term of this patent is extended or adjusted under 35 U.S.C. 154(b) by 225 days.

(21) Appl. No.: 11/585,063

(22) Filed: Oct. 21, 2006

(65) Prior Publication Data

US 2008/0092460 A1 Apr. 24, 2008

(51) Int. Cl.
*E04B 1/98* (2006.01)
*E04H 9/02* (2006.01)

(52) U.S. Cl. ..... 52/167.1; 52/167.8; 52/167.3; 52/167.4; 52/167.2; 52/167.9

(58) Field of Classification Search ..... 52/168.1, 52/168.8, 168.3, 168.4, 168.2, 168.9, 167.1, 52/167.8, 167.3, 167.4, 167.2, 16.97; 248/562, 248/636

See application file for complete search history.

(56) References Cited

U.S. PATENT DOCUMENTS 4,182,504 A * 1/1980 Bernhard ..... 248/636
4,286,777 A * 9/1981 Brown ..... 267/294
4,469,956 A * 9/1984 D'Amato ..... 290/55
4,577,826 A * 3/1986 Bergstrom et al. ..... 248/638
4,605,106 A * 8/1986 Fyfe et al. ..... 188/374
4,615,538 A * 10/1986 Solleder ..... 280/124.125
5,471,810 A * 12/1995 Sugisawa et al. ..... 52/836
5,502,932 A * 4/1996 Lu ..... 52/167.9
5,560,162 A 10/1996 Kemeny
5,641,153 A * 6/1997 Gwinn ..... 267/294
5,797,228 A * 8/1998 Kemeny ..... 52/167.7
5,971,374 A * 10/1999 Freeman ..... 267/134
6,134,858 A * 10/2000 Gutelius et al. ..... 52/698
6,752,389 B2 * 6/2004 Halladay et al. ..... 267/140.12
6,966,154 B1 * 11/2005 Bierwirth ..... 52/167.4
7,070,157 B2 * 7/2006 Huprikar et al. ..... 248/636
7,263,806 B2 * 9/2007 Pellegrino et al. ..... 52/167.8

OTHER PUBLICATIONS

Carl D. Grigorian, et al., "Slotted Bolted Connection Energy Dissipators", Jul. 1992.

Brian G. Morgen, et al., "Seismic Response Evaluation of Post-tensioned Precast Concrete Frames with Friction Dampers", Apr. 2006.

* cited by examiner

*Primary Examiner*—Richard E Chilcot, Jr.
*Assistant Examiner*—Mark R Wendell
(74) *Attorney, Agent, or Firm*—Terry L. Miller

(57) ABSTRACT

A seismic energy damper includes a pair of structure members subject to relative motion during a seismic event, and a pair of friction washers each fixed to a respective one of the structure members and moving relative to one another during the seismic event. A tie bolt resiliently urges the pair of friction washers toward frictional cooperation, and a friction member cooperates with the pair of friction washers to dissipate seismic energy.

21 Claims, 9 Drawing Sheets

SEISMIC ENERGY DAMPING APPARATUS

BACKGROUND OF THE INVENTION

1. Field of the Invention

Figure 1A:
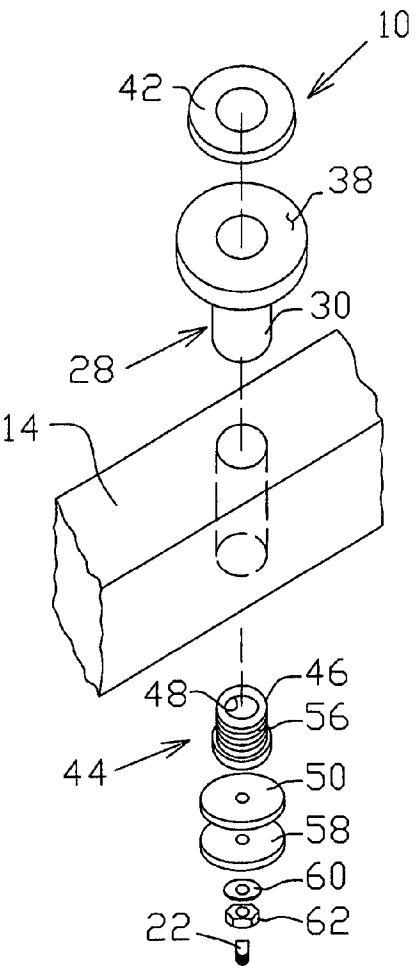

This invention relates to seismic energy dissipation using damping apparatus. More particularly, this invention relates to an apparatus, method, and system for absorbing and dissipating seismic energy manifest by relative movement between two members in a structure, such as a building. The systemic embodiment of this invention in a building includes plural seismic dampers and rigid shear panel members distributed or arrayed in the building so that seismic energy is absorbed and dissipated in a distributed arrangement throughout the building structure which both avoids stress concentrations in the building structure, and dissipates a greater amount of seismic energy than conventionally would be possible using concentrated damping instruments.

2. Related Technology

Seismic energy dissipation using damping devices is well known. For example, a technical paper entitled, *Seismic Response Evaluation of Post-Tensioned Precast Concrete Frames With Friction Dampers*, presented at the Proceedings of the 8$^{th}$ U.S. National Conference on Earthquake Engineering, Apr. 18-22, 2006, San Francisco, Calif., USA. This paper discusses the seismic response evaluation of unbonded post-tensioned precast concrete moment frames with friction dampers at the beam ends. Another type of friction damper is illustrated in a report to the National Science Foundation, entitled, "Slotted Bolted Connection Energy Dissipaters (with April 1993 Addendum of some recent results), published in *Steel Tips*, by the Structural Steel Engineering Council, Technical Information & Product Service, Report No. UCB/EERC-92/10, July 1992. Slotted bolted connections (SBC's) of two types are evaluated for their ability to dissipate energy through friction. One SBC is steel-on-steel, and the other is steel-on-brass.

Further to the above, it is known to provide diagonal braces, either in original construction or as part of a seismic retrofit program, to brace a building having an otherwise open rectangular frame or beam structure. These diagonal braces assist in stiffening the building structure against shear forces resulting from lateral seismic ground motions, and reduce the amplitude of the displacements the building experiences in response to these shear forces. As a result, damage to the building during a seismic event is reduced, and the building will better withstand a higher level of earthquake while cost-effective construction is obtained.

U.S. Pat. No. 5,560,162 illustrates a variation of this diagonal bracing concept, in which the diagonal bracing is accompanied by a so-called seismic brake. The seismic brake includes a cylindrical member or pipe gripped by a gripping block. The gripping strength of the gripping block on the pipe is adjustable, so that below a certain force level, the diagonal brace acts as a rigid connection. However, if the force level between the pipe and gripping block exceeds the certain force level (i.e., as a result of a seismic event) then the pipe and gripping block move relatively to one another, the diagonal brace temporarily becomes flexible (with Coulomb damping), and seismic energy is frictionally dissipated in the seismic brake. Upon the conclusion of the seismic event, the gripping block again grips the pipe immovably, and the diagonal brace is again rigid.

However, the amount of seismic energy which can be dissipated by the seismic brake of the '162 patent is inherently limited by the comparatively small size and extent of the brake defined between the pipe and gripping block. Also, the energy dissipation is concentrated at the gripping block and pipe, so that stress concentrations within the building structure can result. Still further, the structure of the seismic brake is rather expensive, so that building owners are hesitant to install a sufficient number of these devices to deal with predicted seismic forces.

SUMMARY OF THE INVENTION

In view of the deficiencies of the conventional related technology, it is an object of this invention to overcome or reduce one or more of these deficiencies.

It is an object for this invention to provide a structurally simplified seismic energy absorber or damper apparatus.

A further object of this invention is to provide an inexpensive seismic energy damper that can be used for structures consisting of: steel, reinforced concrete, post tensioned concrete, wood, or other materials.

Further, it is an object for this invention to provide such a simplified seismic energy absorber which is comparatively inexpensive and small in size, such that a multitude of the seismic energy absorbers may be distributed at low cost and in significant numbers in a distributed array in a structure, thereby to dissipate in total a greater amount of seismic energy than would otherwise be possible, and to do so within a distributed or arrayed plurality of absorbers spread about the structure, which greatly enhances the redundancy of the seismic dissipation mechanism.

Accordingly, one particularly preferred embodiment of the present invention provides a seismic energy damping apparatus including a pair of structure members juxtaposed to one another, and subject to relative movement during a seismic event. Each of the pair of structure members defines a respective one of a pair of holes generally aligned with one another. Each one of a pair of friction washers are connected substantially immovably to a respective one of said pair of structure members, and this pair of friction washers confront one another and define respective friction surfaces. The pair of friction surfaces cooperate with one another and move relative to one another during a seismic event to frictionally dissipate seismic energy. A resilient tie bolt extends through said aligned pair of holes and urges the pair of structure members and said pair of friction surfaces toward one another with a determined force, thus to substantially determine the frictional damping force effective between said pair of structure members and said pair of friction washers connected thereon. And, the pair of holes are oversized with respect to said tie bolt thus to provide room for said structure members to move relative to one another during the seismic event without binding on said tie bolt.

Accordingly, another particularly preferred embodiment of the present invention provides a seismic energy damping apparatus including a pair of members which are subject to relative motion during a seismic event, the pair of members being disposed adjacent to one another, and each of said pair of members defining a respective one of a pair of holes generally aligned with one another. At least one of said pair of members carries a first element defining a first friction surface disposed toward the other of said pair or members, the other of said pair of members carries a second element defining a second friction surface disposed toward said first friction surface. A thin friction control and damping element is interposed between said first and second friction surfaces. And, an elongate resilient tie rod member extends in said pair of holes with radial clearance accommodating said relative motion of said pair of members during a seismic event. This elongate resilient tie rod member biases said pair of members forcefully toward one another to engage said first and said second friction surfaces frictionally and movably with said interposed friction control and damping element.

Accordingly, still another particularly preferred embodiment of the present invention provides a method of absorbing and dissipating seismic energy, said method including steps of: juxtaposing to one another a pair of structure members which are subject to relative movement during a seismic event; providing for each of the pair of structure members to define a respective one of a pair of holes generally aligned with one another; providing a pair of friction washers each connected substantially immovably to a respective one of said pair of structure members; arranging said pair of friction washers to confront one another, and employing said pair of friction washers to define respective friction surfaces; providing for said pair of friction surfaces to frictionally cooperate with one another and to moving relative to one another during a seismic event to frictionally dissipate seismic energy; providing a resilient tie bolt extending through said aligned pair of holes and urging the pair of structure members and said pair of friction surfaces toward one another with a determined force, thus to substantially determine a frictional damping force effective between said pair of structure members and said pair of friction washers connected thereon; and configuring said pair of holes to be oversized with respect to said tie bolt thus to provide room for said structure members to move relative to one another during the seismic event without binding on said tie bolt.

Advantages of the present invention include that seismic energy is absorbed both in greater amount than would conventionally be possible, and the absorption of this seismic energy is distributed or spread over a greater area or volume of a building structure so that stress concentrations within the building structure are avoided; while a redundant system with significant damping characteristics is achieved. The system is capable of limiting the amplitude of the excursions (or movements) experienced by the building during a seismic event.

Other objects, features, and advantages of the present invention will be apparent to those skilled in the art from a consideration of the following detailed description of a preferred exemplary embodiment thereof taken in conjunction with the associated figures which will first be described briefly.

BRIEF DESCRIPTION OF THE DRAWING FIGURES

Figure 1:
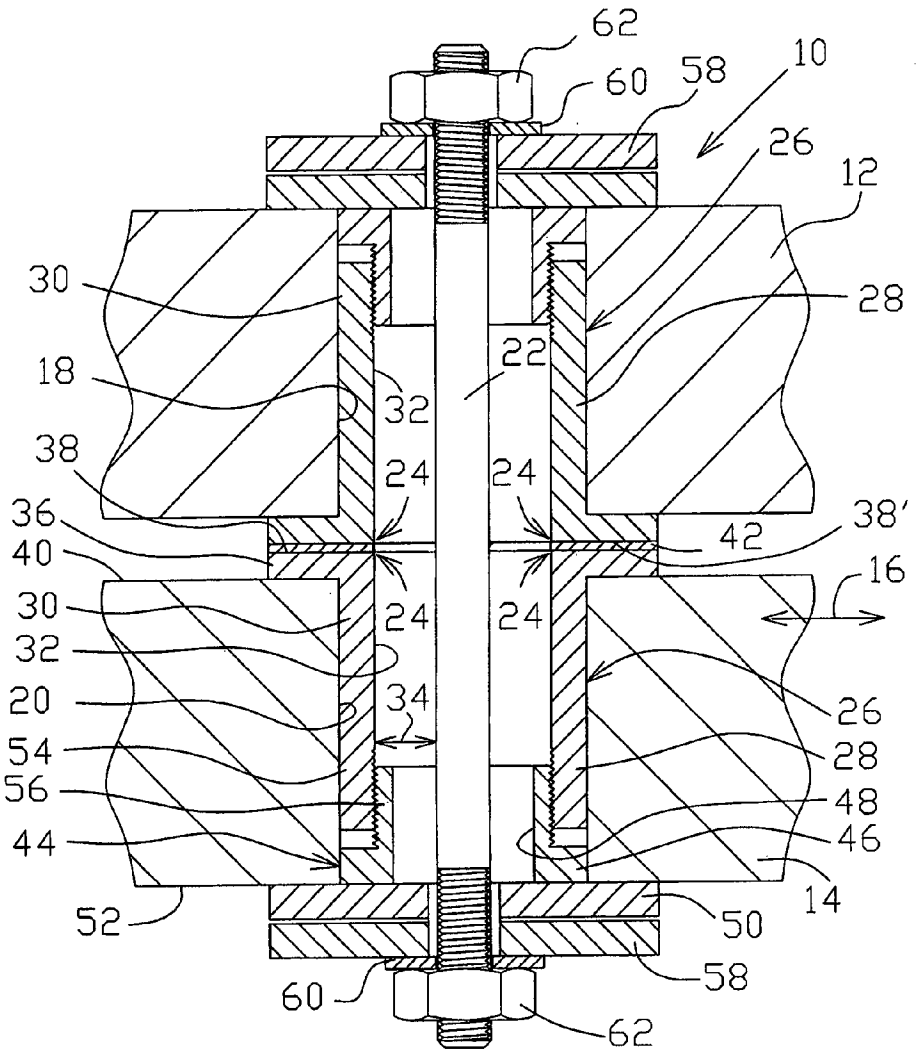
Figure 2:
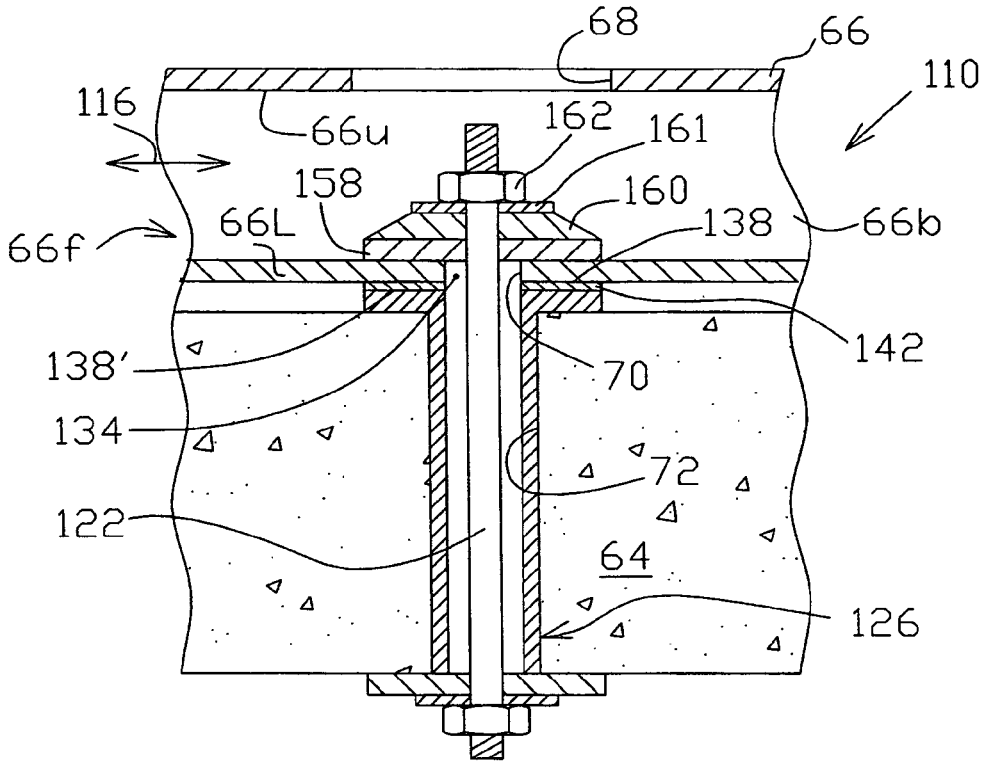
Figure 3:
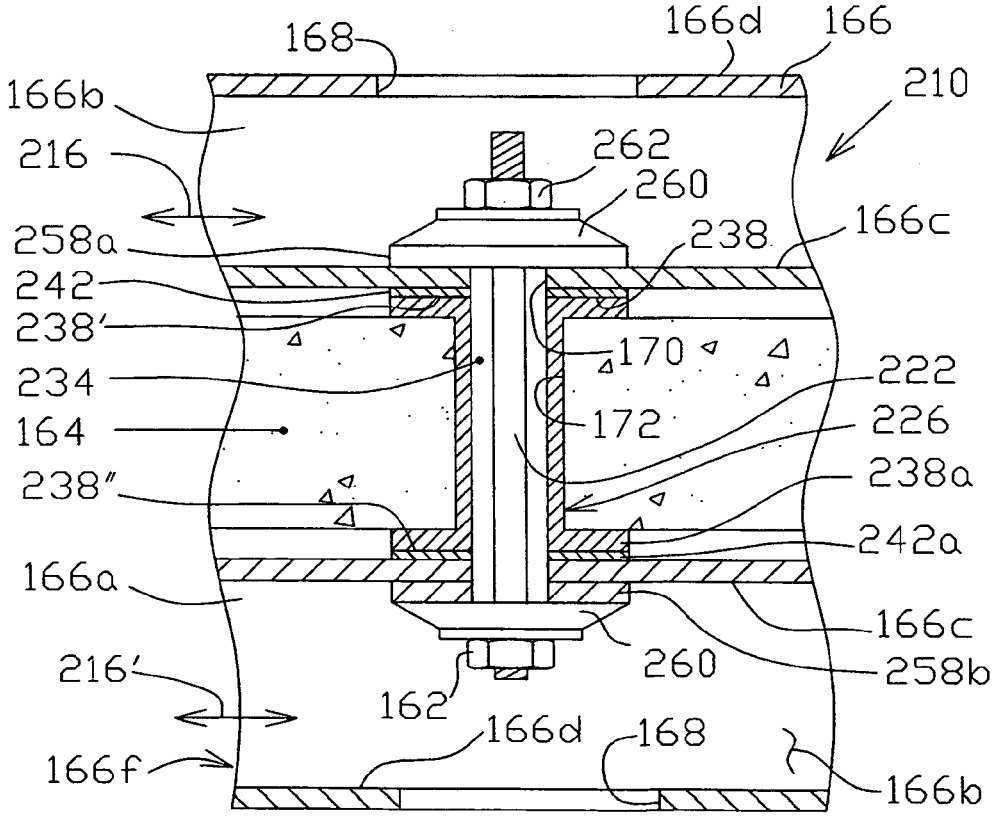
Figure 4:
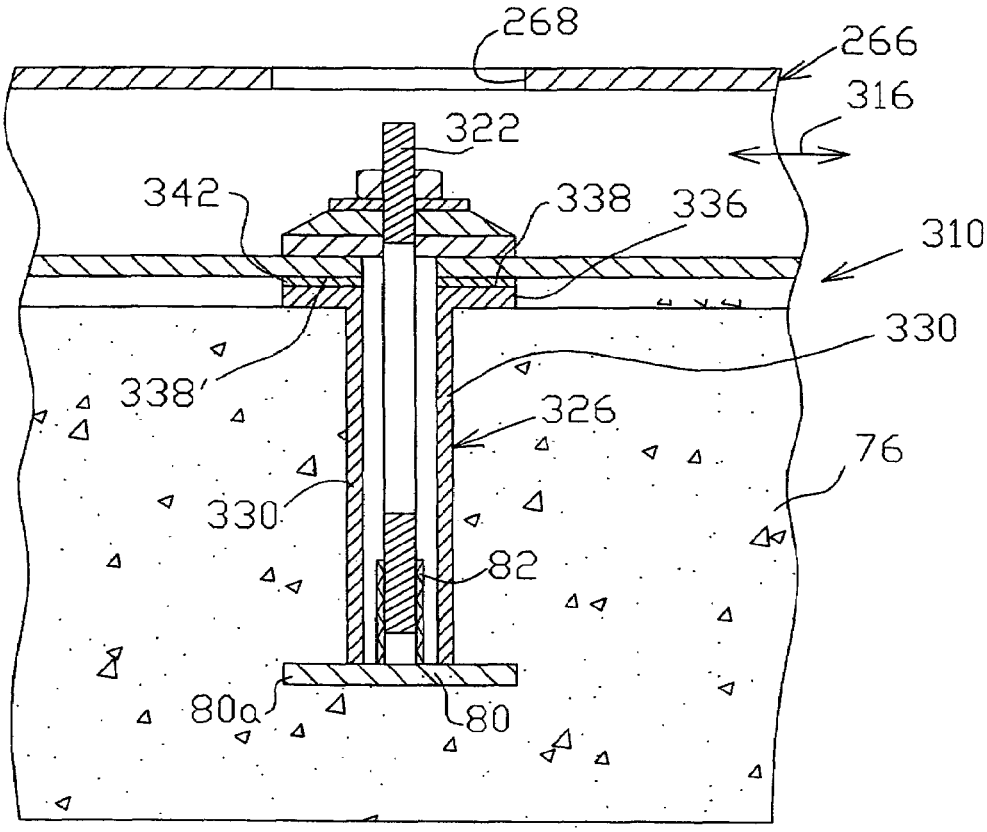
Figure 5:
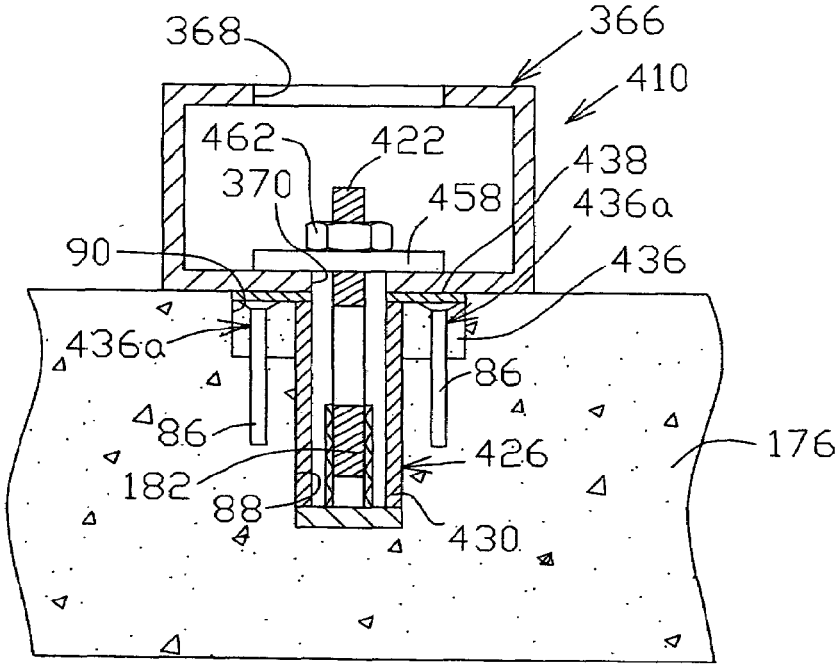
Figure 6A:
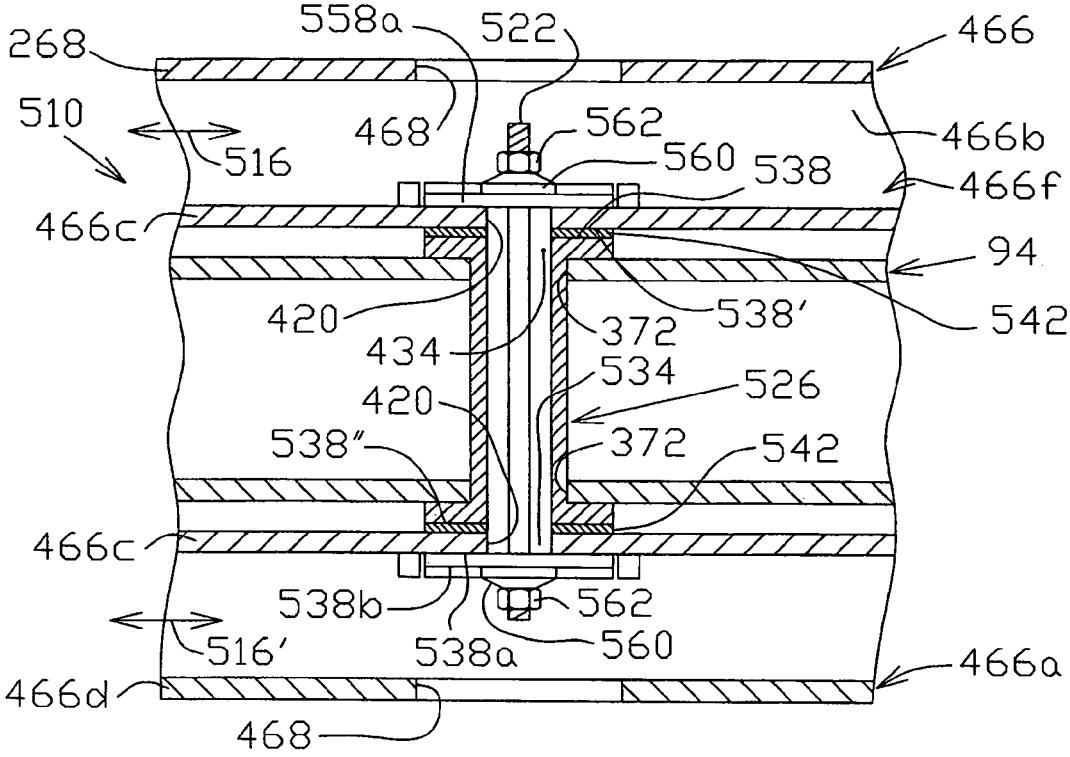
Figure 6B:
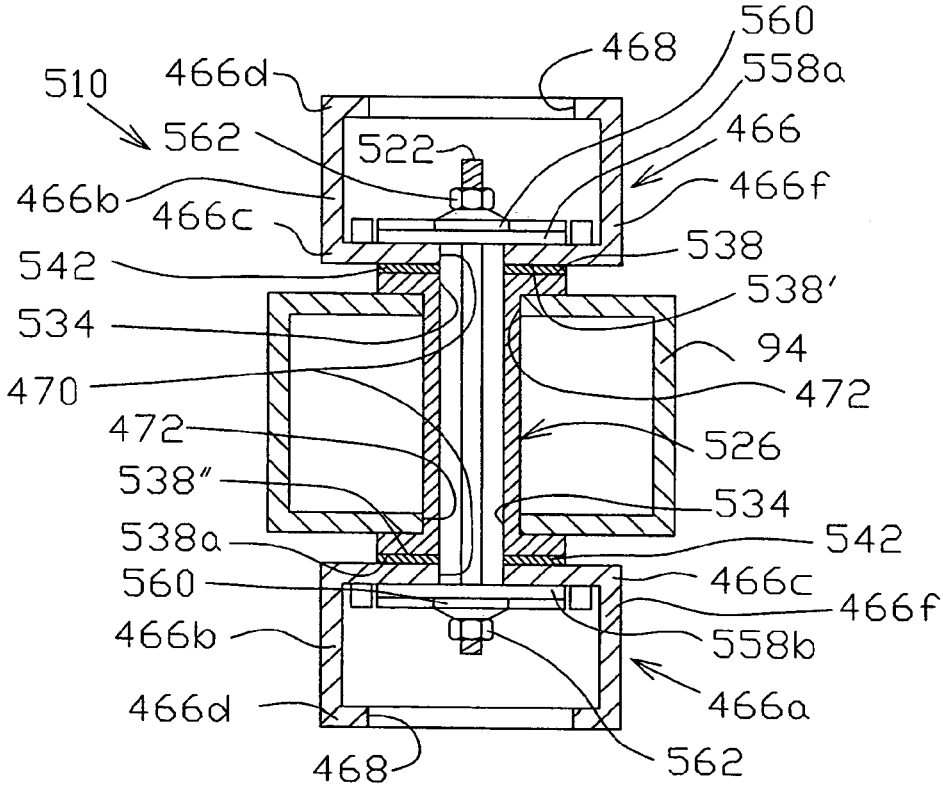
Figure 8:
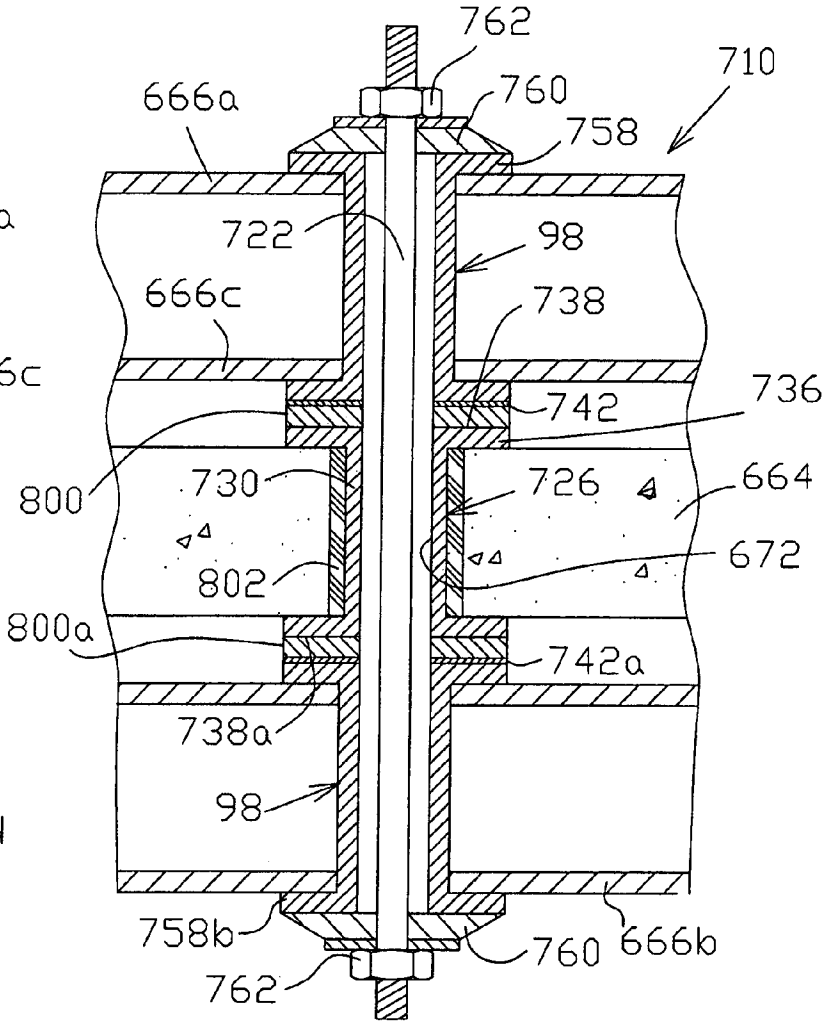
Figure 7:
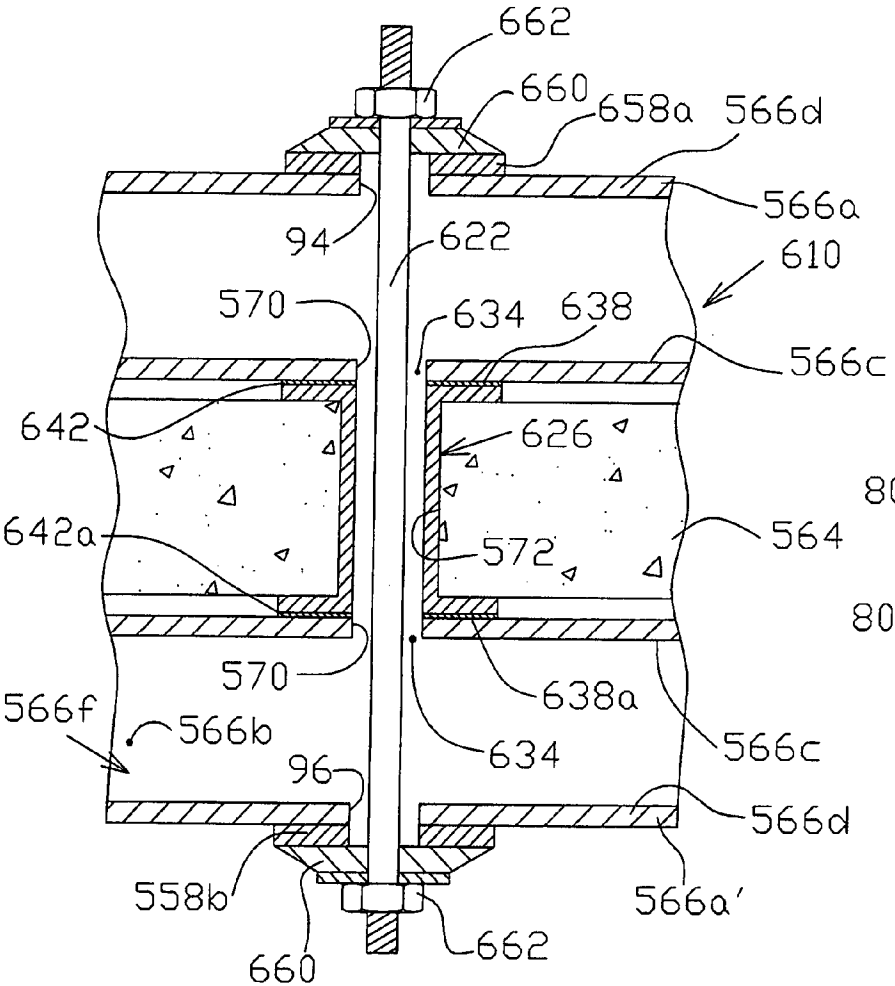
Figure 8A:
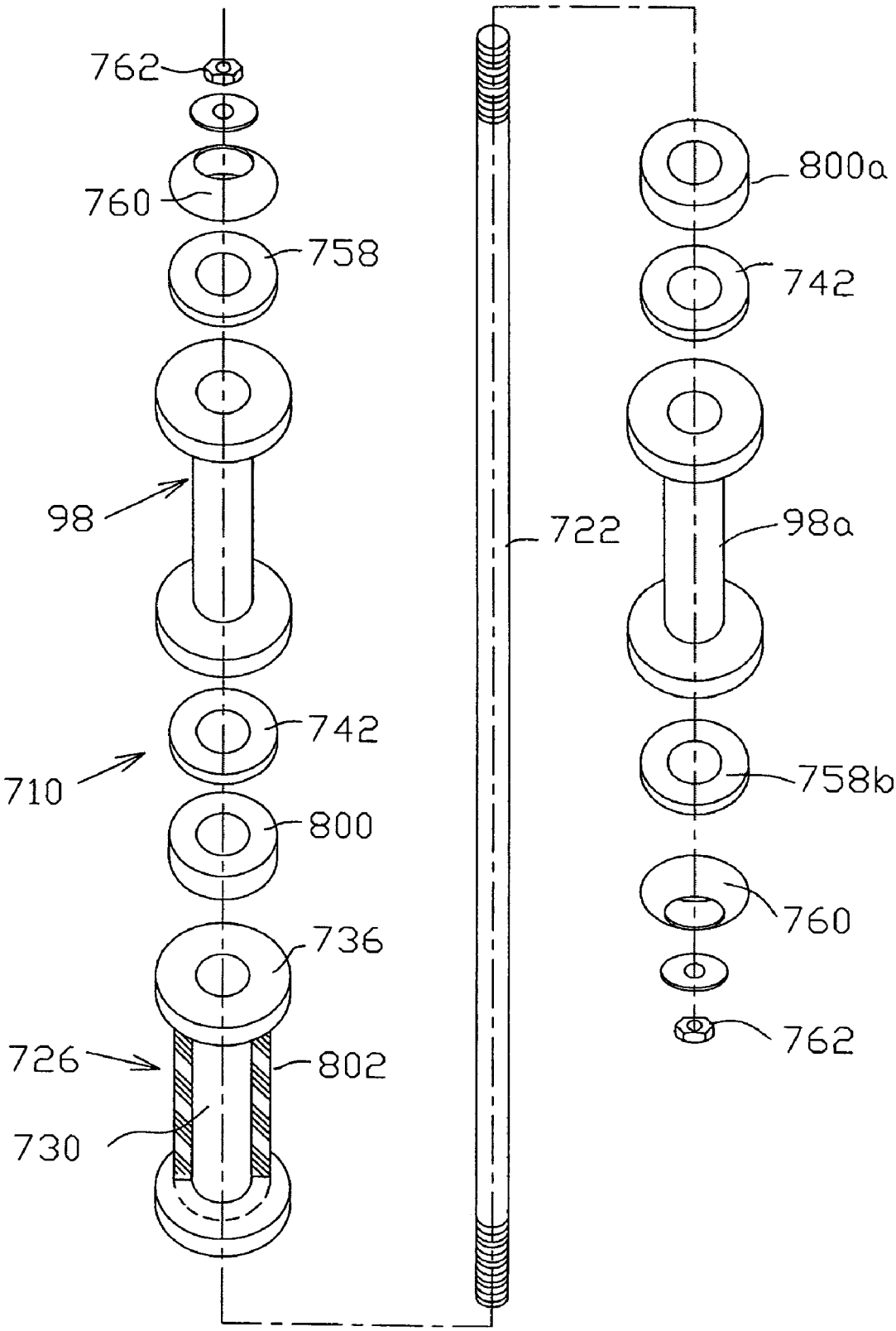
Figure 10:
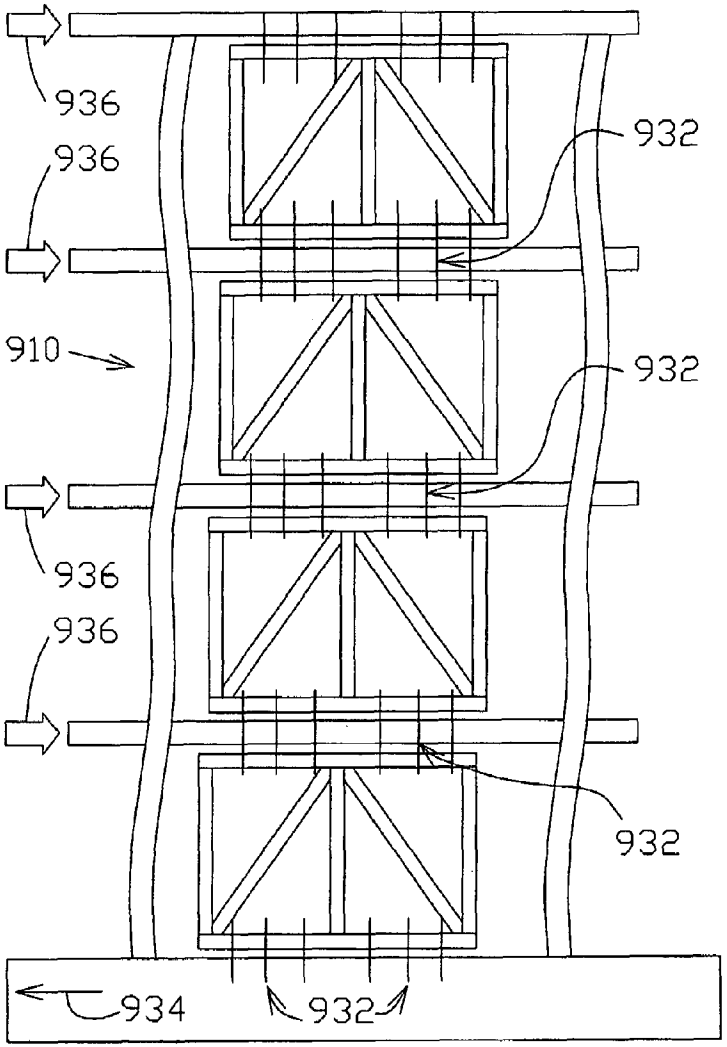
Figure 9:
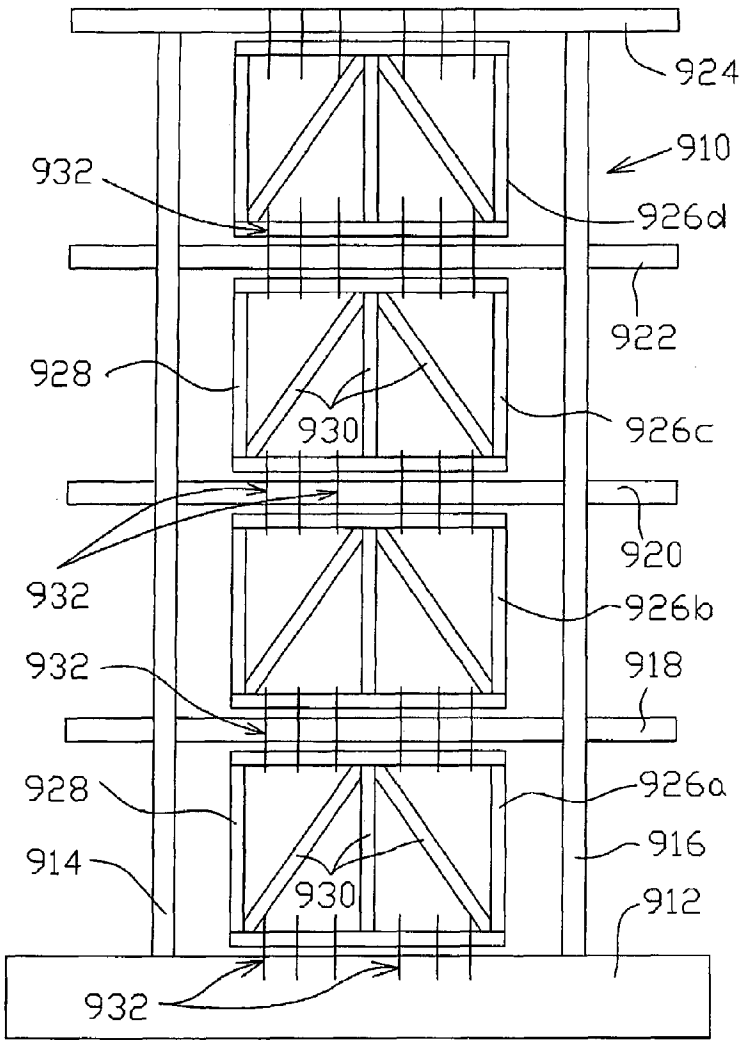
Figure 11:
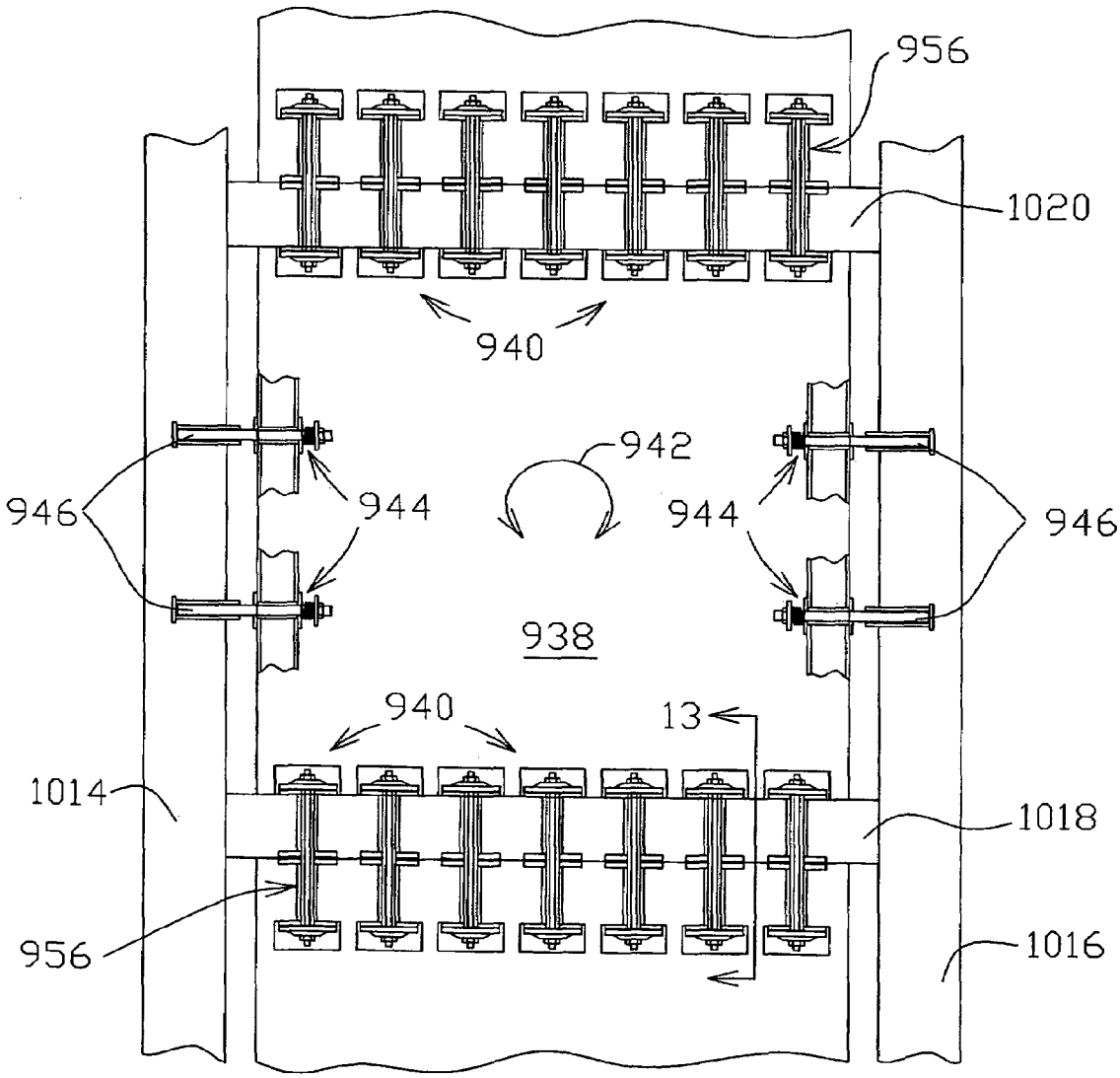
Figure 13:
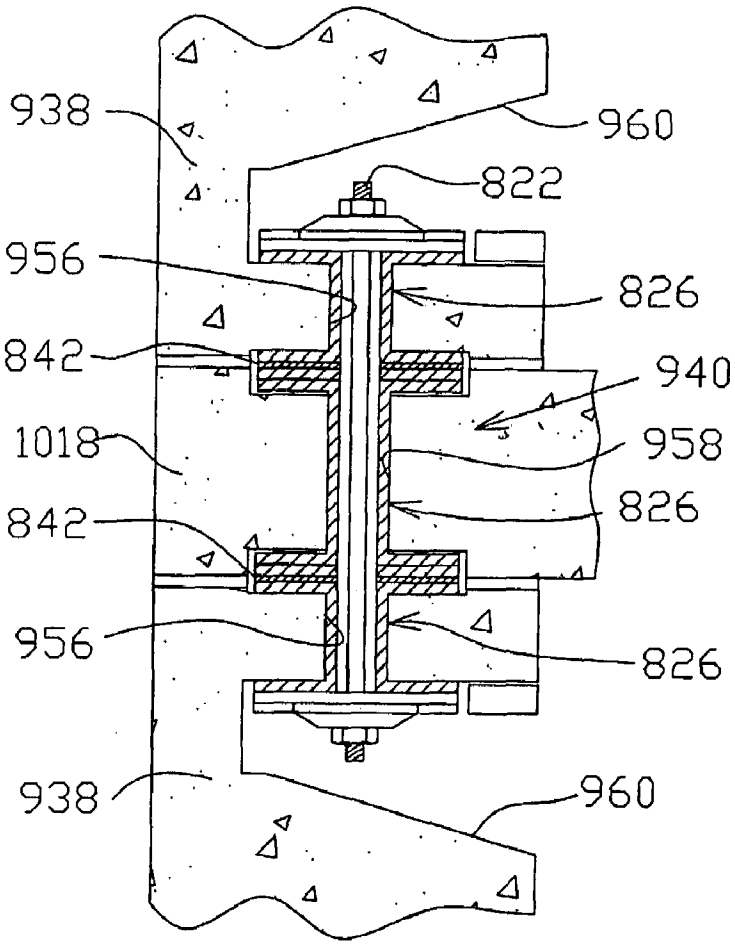
Figure 12:
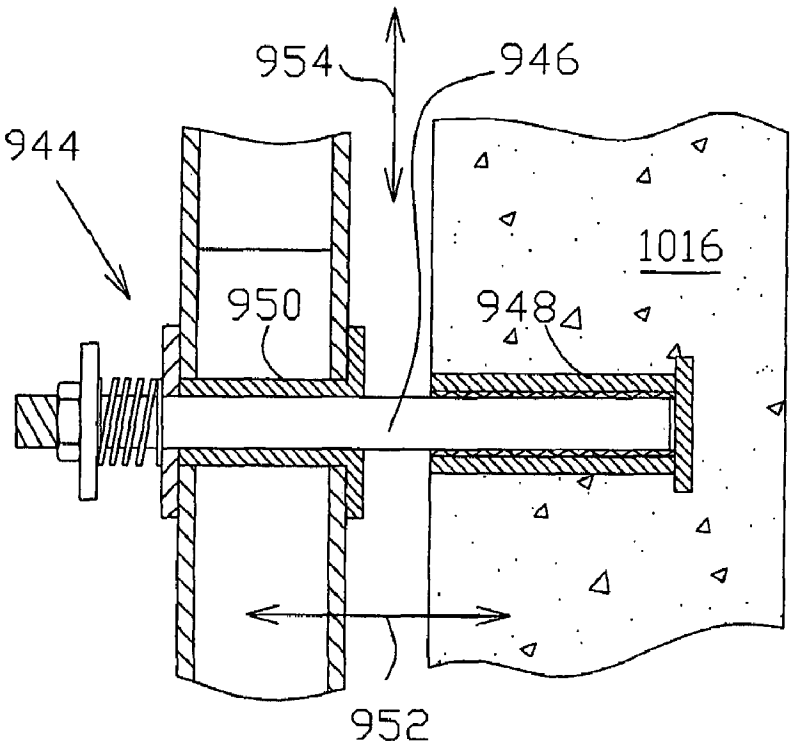

FIG. 1 provides a simplified illustration, partly in cross section, of a seismic damping assembly according to a particularly preferred embodiment of the present invention;

FIG. 1A is a fragmentary perspective view of a portion of the seismic damping assembly seen in FIG. 1, with parts there of omitted for simplicity and clarity of illustration;

FIG. 2 provides a diagrammatic illustration, partly in cross section, of an alternative embodiment of seismic damping assembly according to this invention connecting a reinforced concrete element (e.g., a slab or beam) to a steel or tube frame member;

FIG. 3 provides a diagrammatic illustration, partly in cross section, of yet another alternative embodiment of a seismic damping assembly according to this invention connecting a reinforced concrete element (e.g., a slab or beam) to a pair of steel tube frame members, one disposed above and the other disposed below the concrete slab or beam;

FIG. 4 provides a diagrammatic illustration, partly in cross section, of an alternative embodiment of a seismic damping assembly according to this invention connecting a thick or deep reinforced concrete element, (such as a slab, beam, or foundation member, for example), to a steel tube frame member;

FIG. 5 provides a diagrammatic illustration, partly in cross section, of yet another alternative embodiment of a seismic damping assembly according to this invention connecting a reinforced concrete element (a slab or foundation member, for example), to a steel tube frame member;

FIGS. 6A and 6B in conjunction provide diagrammatic illustrations, partly in cross section, of a seismic damping assembly according to another alternative embodiment of this invention connecting a larger or principal steel tube frame member to a pair of smaller or secondary steel tube frame members, with one of the smaller frame members being disposed above and the other disposed below the principal frame member;

FIG. 7 provides a diagrammatic illustration, partly in cross section, of another embodiment of a seismic damping assembly according to this invention, which is somewhat similar to the embodiment of FIG. 3, and which connects a reinforced concrete element (such as a slab or beam) to a pair of steel tube frame members, one disposed above and the other disposed below the reinforced concrete element;

FIGS. 8 and 8A respectively provide a diagrammatic illustration, partly in cross section, and a fragmentary exploded perspective view, of still another embodiment of a seismic damping assembly according to this invention, which is somewhat similar to the embodiments of FIGS. 3 and 7, and which connects a reinforced concrete element (slab or beam) to a pair of steel tube frame members, one disposed above and the other disposed below the reinforced concrete element;

FIGS. 9 and 10 respectively provide diagrammatic illustrations of a building structure having reinforced concrete or steel columns and beams, with FIG. 9 showing the building in its normal position of repose, and FIG. 10 illustrating the building during a seismic event involving lateral ground motion, and diagrammatically illustrates one embodiment of a steel-frame shear panel and distributed damper system;

FIG. 11 diagrammatically illustrates an alternative shear panel and distributed seismic damper assembly and system, in which the shear panel is constructed of concrete;

FIG. 12 provides a detailed illustration, partly in cross section, of one of a plurality of guide or retention members maintaining a desired relationship between the shear panel seen in FIG. 11 and the frame of a building; and FIG. 13 provides a detailed illustration, partly in cross section, viewed in the direction of arrows 13-13 on FIG. 11, of one of a plurality of seismic energy dampers as seen in FIG. 11;

DETAILED DESCRIPTION OF AN EXEMPLARY PREFERRED EMBODIMENT OF THE INVENTION

While the present invention may be embodied in many different forms, disclosed herein are several specific exemplary preferred embodiment which illustrate and explain the principles of the invention. In conjunction with the description of these embodiments, a method of providing for seismic energy dissipation and for distributed dissipation of seismic energy in a building structure will be apparent. It should be emphasized that the present invention is not limited to the specific embodiments illustrated.

FIG. 1 illustrates a seismic damper, generally indicated with the arrowed numeral 10. This seismic damper includes two members 12, 14, which may, for example, be beams or slabs. These two members 12 and 14 are adjacent to one another, perhaps as part of the structure of a building. During a seismic event these two members are subjected to lateral relative motion, illustrated by the double headed arrows 16 on FIG. 1. As is illustrated by FIGS. 1 and 1A in conjunction with one another, each of the members 12 and 14 defines a through hole 18, 20 (only the beam 14 and hole 20 being seen in FIG. 1A). The through holes 18 and 20 are most preferably round in cross section, although the invention is not so limited. That is, the holes 18 and 20 could be oval, or square, or another shape in cross section if that were desired. As FIG. 1 shows, the holes 18 and 20 are generally aligned with one another within structural tolerances, and an elongate tie bolt or rod 22 extends within the holes 18, 20, and passes between the two members 12, 14. Importantly, the holes 18, 20 are sufficiently larger than the tie bolt 22 that the motions experienced between the two members during a seismic event (recalling arrows 16) do not result in the tie bolt 22 binding in the holes by forceful contact at surrounding surfaces generally indicated by the arrowed numeral 24.

In the embodiment of seismic damper seen in FIGS. 1 and 1A, each of the members 12, 14 receives a spool assembly, generally indicated with the numeral 26. Because each of the spool assemblies 26 is substantially the same, only the assembly carried in member 14 will be described in detail, with the spool assembly 26 carried in the member 12 being substantially the same (although inverted in position relative to the assembly 14). Viewing FIG. 1, it is seen that the spool assembly 26 includes a flanged tubular member 28 having a tubular body 30 closely received into hole 20. The tubular body defines a through bore 32 passing the tie bolt 22 with a generous radial clearance 34. The tubular body 30 also carries or includes an annular flange portion 36 (i.e., generally like a large washer) interposed between the two members 12, 14, and defining a first friction surface 38 disposed toward the other member 12. The flange portion 36 bears upon a surface 40 of the member 14 which is disposed toward member 12. In this embodiment, a second friction surface 38' is defined by the other spool assembly 26 carried in the other member 12. Most preferably, the flange portions 36 of each of the spool assemblies 26 in the members 12 and 14 are made of steel. So, the friction surfaces 38 and 38' are defined by steel. Interposed between the friction surfaces 38 and 38' is a rather thin annular friction member 42, which is most preferably made of brass, although the invention is not so limited. It is to be noted that the friction member 42 is optional and that the friction surfaces 38 and 38' can directly engage one another. However, it is preferred to include a friction member (such as the brass friction member 42) between the friction surfaces 38 and 38' because the nature of the Coulomb damping (i.e., frictional damping) occurring between the spool assemblies 26 (and therefore, between members 12 and 14) can be selected to be of a more desirable nature.

In order to securely attach the spool assembly 26 to member 14, the assembly 26 also includes a second flanged tubular member 44 having a tubular body 46 closely received into hole 20. The tubular body 46 defines a stepped through bore 48 including a smaller-diameter portion closely passing the tie bolt 22. The tubular body 46 also defines or includes a flange portion 50 engaging surface 52 of member 14, which is opposite to the surface 40. The two tubular bodies 30 and 46 each define a respective thread-defining tubular portion 54 and 56, which threadably engage one another. That is, by relative rotation of the tubular bodies 30 and 46 of the flanged tubular members 28 and 44, the spool assembly 26 is tightened on the member 14 so that the flange portions 26 and 50 each engage tightly against the respective surfaces 40 and 52.

Further to the above, the seismic damper 10 includes elongate tie bolt 22, which as described earlier passes along the bores of the spool assemblies 26 in each of the members 12 and 14. This tie bolt 22 at each of its opposite end portions 22' receives a respective one of a pair of heavy washers 58, and a respective one of a pair of smaller washers 60. The pair of heavy washers respectively bear on a respective one of the spool assemblies 26 at the second flanged tubular member 44. A respective one of a pair of nuts 62 threadably engages each end of the tie bolt 22, and is tightened to a desired certain level to bias the friction surfaces 38, 38' toward one another. That is, the friction surfaces 38, 38' are biased with a determined certain force into engagement with the friction member 42. It is to be noted that the elongate tie bolt 22, partly because of its length, possesses a certain resilience. But, in order to provide an increased level of resilience for the tie bolt, if desired, the smaller washers 60 may be of a Belleville configuration. That is, the washers 60 may be themselves of a resilient type. Alternatively, the smaller washers 60 may be of a stress indicator type which is useful to measure or indicate the level of pre-load applied by tie bolt 22.

Having observed the structure of the seismic damper 10 attention may now be directed to its operation and effect during a seismic event causing relative motion of the members 12, 14, as is indicated by arrow 16. It will be noted that below a certain force level along the direction of arrow 16, the clamping force provided by tie bolt 22, and the frictional engagement of the spool assemblies 26 with the friction member 42 results in a rigid connection of the members 12 and 14 to one another. Thus, during normal repose of the building or structure, for example, including the members 12, 14, or during a small seismic event not sufficient to reach the certain force level, the members 12, 14 remain essentially immovable relative to one another. However, in the event that a seismic event is sufficiently forceful that the force level along the lines of arrow 16 reaches the certain level, then the two members 12, 14, will move relative to one another (recalling arrow 16). This movement will result in relative movement of the two spool assemblies 26 because each is effectively locked to its respective member 12, 14. Thus, the first 38 friction surface will move relative to the second friction surface 38', and each moves relative to the friction member 42. Most desirably, as mentioned above, the friction member is made of brass, which has a particularly desirable Coulomb (i.e., friction) damping characteristic when in contact with steel. That is, a steel-on-brass friction surface combination has been found to provide a uniform hysterisis. The Coulomb damping effective between the two spool assemblies 26 of the damper 10 is effective to dissipate a considerable amount of energy at the seismic damper 10. Importantly, because of the generous radial clearance 34 between the tie bolt 22 and the surrounding surfaces 24 within the spool assemblies 26 adjacent to (or in the plane of) the friction surfaces 38, 38', the spool assemblies do not forcefully contact the tie bolt at this location. That is, the tie bolt 22 does not bind or interfere with the movements of the members 12, 14 indicated by the arrow 16. Thus, the seismic damper is free to and does dissipate a considerable amount of seismic energy.

Turning now to FIG. 2, and alternative embodiment of seismic damper is illustrated. Because the seismic damper of FIG. 2 has many features which are the same or analogous in structure or function to those features already depicted and described by reference to FIG. 1, those features are indicated on FIG. 2 with the same numeral used above, but increased by one-hundred (100). In FIG. 2, the seismic damper 110 connects a reinforced concrete slab or beam 64 to a steel tube frame member 66. The members 64 and 66 are subject to relative motion indicated by arrow 116 during a seismic event. Most preferably, the steel tube frame member 66 is rectangular in cross section, so that this frame member includes an upper wall 66*u*, a lower wall 66*l*, a back wall 66*b*, and a front wall 66*f* (which front wall is not seen in the drawing Figures but is indicated by the arrowed numeral). The upper wall 66*u* defines a rather large hole or opening 68, the function of which will be described below. Aligned with the large upper hole 68, the lower wall 66*l* defines a somewhat smaller hole 70, which will be seen to provide a generous radial clearance 134 about a tie bolt 122 passing through this smaller hole.

Turning to the concrete slab or beam 64 seen in FIG. 2, it is seen that this slab or beam 64 defines a through hole 72. Fixedly received in this through hole 72 is a spool assembly 126 in all ways comparable to the spool assembly 26 depicted and described above. This spool assembly 126 defines a first function surface 138. However, in the seismic damper of FIG. 2, the steel tube frame member 66 is itself made of steel, and thus may itself be used as an active and functional part of the seismic damper 110. That is, a respective spool assembly disposed in the steel tube frame member 66 is not required. Moreover, a portion of the lower wall 66*l* of the steel tube frame member immediately surrounding the smaller hole 70 defines a second friction surface 138' which engages a friction member 142. However, in this embodiment, a heavy washer 158 bears directly upon the upper surface of lower wall portion 66*l*, and a Belleville washer 160 bears upon the heavy washer 158 and is secured by a nut 162 engaging the tie bolt 122. As can be seen by viewing FIG. 2, the large hole 68 in upper wall 66*u* provides for the heavy washer 158, Belleville washer 160, and nut 162 to be put into place. Again, an indicator washer may be used as washer 160 for purposes of indicating the pre-load applied to tie bolt 122. The seismic damper of FIG. 2 functions as described above for the seismic damper of FIGS. 1 and 1A.

Considering FIG. 3, another alternative embodiment of seismic damper is illustrated. Because the seismic damper of FIG. 3 also has many features which are the same or analogous in structure or function to those features already depicted and described by reference to FIGS. 1 and 2, those features are indicated on FIG. 3 with the same numeral used above, but increased by two-hundred (200) over FIG. 1, or by 100 over FIG. 2. In FIG. 3, the seismic damper 210 connects a reinforced concrete slab or beam 164 to a pair of steel tube frame member 166/166*a*. In this case, the one frame member 166 is located above the slab or beam 164, while the other frame member 166*a* is located below. The members 164 and 166/166*a* are subject to respective relative motions indicated by arrows 216 and 216' during a seismic event. It is to be noted that in this case, the arrows 216, 216' are indicative of relative motions which can be different from one another. One aspect of this relative motion 216, 216' applies between member 164 and frame member 166, while the other aspect appears between the member 164 and frame member 166*a*.

Again, and most preferably, the steel tube frame members 166 and 166*a* are rectangular in cross section, so that these frame members each include a wall 166*c* (i.e., closest to the slab or beam 164), a wall 66*d* (i.e., distant from the slab or beam 164), a back wall 166*b*, and a front wall 166*f* (which is not seen in the drawing Figures but is indicated by the arrowed numeral). The wall 66*d* defines a rather large hole or opening 168, the function of which will already be clear in view of the disclosure above concerning the embodiment of FIG. 2. Aligned with the large holes 168, the wall 166*d* defines a somewhat smaller hole 170, which will be seen to provide a generous radial clearance 234 about a tie bolt 222 passing through this smaller hole.

Turning to the concrete slab or beam 164, it is seen that this slab or beam 164 defines a through hole 172. Fixedly received in this through hole 172 is a spool assembly 226 which in this case defines not only the first friction surface 238 confronting member 166, but also defines a friction surface 238*a* confronting the member 166*a*. In this case, the friction surface 238 engages a friction member 242 engaging the member 166 at second friction surface 238', and the friction surface 238*a* engages a second friction member 242*a* engaging the member 166*a* at a respective second friction surface 238" defined by this member 166*a*. That is, the spool assembly in this instance defines respective first friction surfaces 238, 238*a* at each of its opposite ends, and the members 166 and 166*a* each define respective second friction surfaces 238', 238", which respectively engage friction members 242 and 242*a* interposed therebetween.

In this embodiment of FIG. 3, respective ones of a pair of heavy washer 258*a* and 258*b* each bear directly upon the respective wall portions 166*c* of the frame members 166 and 166*a*, and respective ones of a pair of Belleville washers 160 bear upon the heavy washers 158*a*, 158*b* and are each secured by a respective nut 262 engaging the tie bolt 222. In this case, as a result of relative movement between the slab 164 and each of the frame members 166 and 166*a*, there is frictional motion between each of the spool assembly (i.e., friction surfaces 238 and 238', and each of the frame members 166/166*a*. As a result, the seismic damper 210 is able to dissipate seismic energy at both friction surfaces where relative movement is experienced. Again, in this embodiment, the washers 160 may be of the indicator type.

FIG. 4 provides a diagrammatic illustration of an alternative embodiment of a seismic damping assembly according to this invention connecting a thick or deep reinforced concrete beam, slab, or foundation member, for example, to a steel tube frame member. Because the seismic damper of FIG. 4 has many features which are the same or analogous in structure or function to those features already depicted and described by reference to FIGS. 1-3, those features are indicated on FIG. 4 with the same numeral used above, but increased by three-hundred (300) over FIG. 1, or by an appropriate increment over FIG. 2 or 3. It will be noted viewing FIG. 4 that the steel tube frame member 266 is analogous to members 66 and 166 described above, and is engaged by the seismic damper 310 in the same way as was the case with the dampers of FIGS. 2 and 3. However, attention to the concrete beam, slab, or foundation member 76 of the embodiment seen in FIG. 4 will reveal that the seismic damper 310 is not mechanically locked, or clamped, or tightened to the concrete structure as was the case with the earlier embodiments. That is, the seismic damper 310 of FIG. 4 includes a spool assembly 326 which is (or may be) of a single piece. In other words, the spool assembly 326 may be formed of steel tubing and steel plate material, which are welded together to form an integral spool assembly 326. The spool assembly 326 includes a closed end wall portion 80 defining an outwardly extending flange part 80*a*, and which carries an internally threaded sleeve 82 projecting within the tubular body 330 of the spool assembly 326. The tie bolt 322 threadably engages with the sleeve 82. Tubular body 330 includes a flange portion 336, which defines a friction surface 338.

Importantly, viewing FIG. 4 it is seen that the spool assembly 326 is cast into place within the concrete beam or foundation member 76 so that the body 330 and flange portion 80*a* is embedded permanently in the concrete. Alternatively, the damper 310 may be secured by use of an epoxy, for example.

This aspect of the seismic damper 310 means that the seismic damper may be part of the construction from the time the concrete beam, slab, or foundation member 76 is formed, or that it may be retrofitted to such a member after construction as part of a seismic retrofit program, for example. In other respects, the seismic damper 310 of FIG. 4 is analogous to and functions like the dampers depicted and described above. So, when the foundation member 76 is subject to motion (arrow 316) relative to the frame member 266, the frictional surface 338 moves under load relative to the frictional surface 338' defined by the tubular member 266, with interposed friction member 342 determining the nature of the Coulomb damping effective at the seismic damper 310. As a result, seismic energy is absorbed and dissipated in the damper 310.

Turning now to FIG. 5 a diagrammatic illustration of yet another alternative embodiment of a seismic damping assembly according to this invention is provided. This seismic damper embodiment connects a concrete slab or foundation member, for example, to a steel tube frame member. Importantly, and in contrast to the embodiment depicted and described by reference to FIG. 4, this embodiment of FIG. 5 can be retrofit to an existing concrete structure. As will be seen in view of disclosure following below, the steel frame seen in FIG. 5 may be part of a rigid steel frame shear panel, and the seismic damper of FIG. 5 may be retrofit to a building or structure not having seismic capacity to resist a significant seismic demand.

Because the seismic damper of FIG. 5 has many features which are the same or analogous in structure or function to those features already depicted and described by reference to FIGS. 1-4, those features are indicated on FIG. 5 with the same numeral used above, but increased by four-hundred (400) over FIG. 1, or by a appropriate increment over FIGS. 2-4. It will be noted viewing FIG. 5 that the steel tube frame member 366 is analogous to and is engaged by the seismic damper 410 in the same way as was the case with FIGS. 2, 3 and 4. However, the direction of the view in FIG. 5 is parallel to (rather than perpendicular to) the length of the steel tube frame member 366. Further, attention to the concrete beam, slab, or foundation member 176 of the embodiment seen in FIG. 5 will reveal that the seismic damper 410 is not mechanically locked, or clamped, or tightened to the concrete structure as was the case with the earlier embodiments of FIGS. 1-3. The spool assembly 426 of this seismic damper 410 is also not cast in place in the concrete as was the case with the seismic damper 310 of FIG. 4. Instead, the seismic damper 410 of FIG. 5 is especially configured to allow it to be part of a retrofit program which may be effected to an existing structure or building.

In order to so allow the seismic damper 410 to be fitted to an existing building structure, the damper 410 includes a spool assembly 426 having a cylindrical tubular body 430 defining or including a top flange portion 436. This top flange portion 436 is provided with plural recessed or countersunk bold holes 436*a*, through which plural fasteners 86 extend to threadably engage into the concrete slab or foundation portion 176. That is, with an existing building structure including the slab or foundation portion 176, a blind hole 88 is bored into the slab or foundation portion 176, and is provided with an enlarged counter bore portion 90. The hole 88 is sized to closely receive the tubular body 430 of the spool assembly 426, while the counterbore 90 is sized to allow the flange 436 to set close to flush with the top surface of the slab or foundation. Thus, the spool assembly is fitted into the hole 88 and is secured by fasteners 86. Again, an epoxy may also be used to secure, or to assist in securing, the spool assembly 426 in hole 88. It also should be noted that the fasteners 86 could be of the expanding type, or could be anchored in epoxy, and that epoxy could be used about the assembly 426 to securely seat this assembly in the hole 88. The anchoring resistance of the assembly 426 in hole 88 is designed to exceed the tension in tie bolt 422. As was the case with the spool assembly 326 seen in FIG. 4, the spool assembly 426 of FIG. 5 includes a threaded sleeve portion 182 for threadably receiving an elongate tie bolt 422. The steel tube frame member 366 is provided with holes 368 and 370 allowing on the one hand access for fitting the large washer 458 and nut 462, and on the other hand to allow the steel tube frame member 366 to be received over the projecting portion of the tie bolt 422. Preferably, a friction member 442 is interposed between the top of flange portion 436 and friction surface 438 thereof, and the steel tube frame member 366. The embodiment of seismic damper illustrated in FIG. 5 functions as described above.

Considering now the seismic damper of FIG. 6, it will be seen that this damper has many features in common particularly with that embodiment of FIG. 3. However, the embodiment of FIG. 3 attached an interposed concrete slab or beam to a pair of steel tubing frame members. In the embodiment of FIG. 6, a large or principal steel tube frame or beam member is interposed between and connected to a pair of steel tube frame members. By way of example, and as will become more clear in view of disclosure following below, the pair of steel tubing frame members may each be a respective part of a pair of rigid steel tube shear panels, disposed one above and one below the principal steel tubing frame or beam member.

Because the seismic damper of FIG. 6 also has many features which are the same or analogous in structure or function to those features already depicted and described by reference to earlier drawing Figures, those features are indicated on FIG. 6 with the same numeral used above, but increased by one-hundred (100) over their earlier or last use. In FIG. 6, the seismic damper 510 connects a rather large or principal steel tube frame or beam member 94 to a pair of steel tube frame member 466*a*/466*a*'. In this case, the one frame member 466*a* is located above the member 94, while the other frame member 466*a*' is located below. The members 94 and 466*a*/466*a*' are subject to relative motions indicated by arrows 516, 516' during a seismic event. One aspect of these relative motions 516, 516' applies between member 94 and frame member 466*a*, while the other aspect appears between the member 94 and frame member 466*a'*.

Again, and most preferably, the steel tube frame members 466*a* and 466*a*' are rectangular in cross section, so that these frame members each include a wall 466*c* (i.e., closest to the slab or beam 94), a wall 466*d* (i.e., distant from the slab or beam 94), a back wall 466*b*, and a front wall 466*f* (which is not seen in the drawing Figures but is indicated by the arrowed numeral). The wall 466*d* defines a rather large hole or opening 468, the function of which will already be clear in view of the disclosure above concerning the embodiment of FIG. 3. Aligned with the large holes 468, the wall 466*d* defines a somewhat smaller hole 470, which will be seen to provide a generous radial clearance 534 about a tie bolt 522 passing through this smaller hole.

Turning to the principal steel tube frame or beam 94 seen in FIG. 6, it is seen that this member 94 defines a through hole 472. Fixedly received in this through hole 472 is a spool assembly 526 which in this case again defines not only the first friction surface 538 confronting beam 466*a*, but also defines a friction surface 538*a* confronting the member 466*a*'. In this case, the friction surface 538 engages a friction member 542 engaging the member 466*a* at second friction surface 538', and the friction surface 538*a* engages a second friction member 542*a* engaging the member 466*a*' at a respective second friction surface 538" defined by this member 466*a*'. In this embodiment, the spool assembly 526 may be welded into place within beam 94 if desired.

In this embodiment of FIG. 6 also, respective ones of a pair of heavy washers 558*a* and 558*b* each bear directly upon the respective wall portions 466*c* of the frame members 466*a* and 466*a*', and respective ones of a pair of Belleville washers 560 bear upon the heavy washers 558*a*, 558*b* and are each secured by a respective nut 562 engaging the tie bolt 522. This embodiment of seismic damper also functions as described above.

FIG. 7 illustrates an alternative embodiment of seismic damper having many similarities to the embodiment of FIG. 3; as well as an important difference. Again, because the seismic damper of FIG. 7 has many features which are the same or analogous in structure or function to those features already depicted and described by reference earlier drawing Figures, those features are indicated on FIG. 7 with the same numeral used above, but increased by one-hundred (100) over their earlier or last use. In FIG. 7, the seismic damper 610 connects a reinforced concrete slab or beam 564 to a pair of steel tube frame member 566*a*/566*a*'. The steel tube frame members 566*a* and 566*a*' are rectangular in cross section, so that these frame members each include a wall 566*c* (i.e., closest to the slab or beam 564), a wall 566*d* (i.e., distant from the slab or beam 664), a back wall 566*b*, and a front wall 566*f* (which is not seen in the drawing Figures but is indicated by the arrowed numeral). Each wall 566*c* defines a hole 570 providing a generous radial clearance 634 about a tie bolt 622 passing through this hole 570.

Turning to the concrete slab or beam 564 of FIG. 7, it is seen that this slab or beam 564 defines a through hole 572. Fixedly received in this through hole 572 is a spool assembly 626 which in this case also defines a pair of oppositely disposed first and second friction surfaces 638 and 638*a*. These friction surfaces respectively confront member 566*a* and 566*a*'. In this case also, a pair of friction members 642 and 642*a* are interposed between the friction surfaces of the spool assembly 626 and the steel tube frame members 566*a* and 566*a*'. However, in this embodiment the opposite walls 566*d* of each steel tube frame member 566*a* and 566*a*' also define a respective hole 96 about the same size as hole 570. The tie bolt 622 in this embodiment of FIG. 7 is thus considerably longer than was the case in the embodiment of FIG. 3, and passes completely through the steel tube frame members 566*a* and 566*a*'. Again, a pair of heavy washer 658*a* and 658*b* each bear directly upon the steel tube frame members 566*a* and 566*a*', and respective ones of a pair of Belleville washers 660 bear upon the heavy washers 658*a*, 658*b* and each is secured by a respective nut 662 engaging the tie bolt 622. Again, this seismic energy damper functions as described above.

FIGS. 8 and 8A illustrate another alternative embodiment of seismic damper having many similarities to the embodiments of FIGS. 3 and 7. Because the seismic damper of FIG. 8 has many features which are the same or analogous in structure or function to those features already depicted and described by reference earlier drawing Figures, those features are indicated on FIG. 8 with the same numeral used above, but increased by one-hundred (100) over their earlier or last use. However, as will be seen, the embodiment of FIGS. 8 and 8A also includes provision not only for effecting Coulomb (i.e., friction) damping between the interconnected structure members, but of also effecting viscous damping between these structure members. In FIGS. 8 and 8A, the seismic damper 710 also connects a reinforced concrete slab member or beam 664 to a pair of steel tube frame member 666*a*/6566. The steel tube frame members 666*a* and 666*a*' may be rectangular in cross section, although this is not required. That is, the steel tube frame members 666*a* and 666*b* could be round in cross section if desired. The concrete slab or beam 664 carries a spool assembly 726 substantially similar to the spool assembly 626 described above with reference to FIG. 7. The spool assembly 726 defines a pair of oppositely disposed first and second friction surfaces 738 and 738*a*. These friction surfaces are defined respectively by friction members 742 and 742*a* Further, as is best illustrated in FIG. 8A, the spool assembly 726 also includes a pair of disks 800, 800*a* each formed of viscoelastic (hereinafter "VE") material. These disks 800 are each attached at one side (i.e., by bonding, for example) to the respective flange portion 736, 736*a* of the spool assembly 726, and are similarly attached at the opposite side to a respective one of the friction members 742, 742*a*. The result is that relative displacement of the friction member 742, 742*a* in the plane of the disks 800, 800*a* distorts the VE material, and results in the VE material absorbing and dissipating (i.e., by viscous damping) seismic energy. Further, as is best seen also in FIG. 8, about the tubular body 730 of the damper assembly 726 is disposed a sleeve member 802 also formed of VE material. In this embodiment, the sleeve 802 is closely fitted within the hole 672 formed in member 764, such that relative motion of the damper assembly 726 and member 672 results in distortion of the VE material of sleeve 802, and consequently results in the absorption and dissipation of seismic energy.

However, in the embodiment of FIG. 8, each of the steel tube frame members 666*a* and 666*b* also carries a respective spool assembly 98 and 98*s*. These spool assemblies may be substantially the same as the spool assembly 26 described with respect to FIG. 1. Alternatively, the spool assemblies 98 and 98*a* my be substantially similar to the spool assembly 526 of FIG. 6, and each may be welded into place in the respective members 666*a*, 666*b*. As was pointed out above, interposed between the respective friction surfaces of the spool assembly 726, 98, and 98*a* are respective friction members 742 and 742*a*. Again, in this embodiment, the tie bolt 722 is sufficiently long that it passes through both of the steel tube frame members 766*a* and 766*b*, to carry heavy washers 758*a* and 758*b* each bearing respectively on the spool assembly 96, 98 in the steel tube frame members 766*a* and 766*b*, while respective ones of a pair of Belleville washers 760 bear upon the heavy washers 758*a*, 758*b*. Again, each end of the tie bolt 722 is secured by a respective nut 762 engaging the adjacent one of the pair of Belleville washers 760. Washers 760 may be of an indicator variety, if desired. Again, this seismic energy damper of FIG. 8 functions as described above, with the exception that at force levels lower than the certain level necessary to result in Coulomb damping at the friction surfaces, the VE material may by distortion and absorption of seismic energy, contribute also to damping of building motions even during relatively small seismic events. In the event of a significant seismic event, the friction (i.e., Coulomb) damping, and the viscous damping effected by the VE material, both contribute to damping of seismic distortions in the building structure. It is noted that there are numerous viscoelastic (VE) materials available in the market today that are used for building seismic and vibration damping. An example of these VE materials which could be used in the current inventive apparatus is a VE material known as Sorbothane®, available from Sorbothane, Inc. of Kent, Ohio. This Sorbothane®, may be used to fabricate the disks 800, 800*a*, and sleeve member 802, although the invention is not so limited.

Turning now to FIGS. 9 and 10 considered in conjunction with one another, it is seen that FIG. 9 illustrates diagrammatically the column and beam structure of a building or structure 910 at repose (i.e., without perturbation by a seismic event). At repose, the columns and beams may be orthogonal, although the invention is not so limited. This building 910 includes a foundation 912, which rests upon and is connected to the ground. Raising from the foundation is seen a pair of columns 914, 916. The building will include other columns as well, but for purposes of illustration, only the columns 914, 916 need be illustrated. These columns 914, 916 support spaced apart beams or floors 918, 920, 922, and 924. The beams or floors may be reinforced concrete. Again, the beams and columns may be orthogonal while the building is in repose, although the invention is not so limited.

Located between the foundation and beam 918, and between each of the beams 920, 922, and 924 are respective ones of plural shear panels 926*a*, 926*b*, 926*c*, and 926*d*. These shear panels 926*a/b/c/d*, are each constructed of steel tubing, including a perimeter frame 928 and bracing 930 including diagonal bracing. Those ordinarily skilled in the pertinent arts will understand that the shear panels 926 may be of different shapes, and may employ different materials of construction, so that the rectangular shape for these shear panels 926 shown in FIGS. 9 and 10 is merely illustrative. Similarly, the shear panels 926 may be made of steel plate, or of concrete, for example. As is seen in FIG. 9, a plurality of seismic energy dampers (represented by arrowed numerals 932) interconnects the shear panels 926*a/b/c/d* with the foundation 912, and beams 918-924 of the building 910. In view of the disclosure above, it may be appreciated that the seismic energy dampers 932 may be selected to be the same (or substantially the same) as the dampers depicted and described by reference to FIGS. 1-8. Particularly, the embodiments of FIGS. 3, 6, 7, and 8 are appropriate for use between the beams and shear panels. On the other hand, the embodiments of seismic damper seen in FIG. 4 or 5 might be used to attach the shear panels to foundation 912.

Turning now to FIG. 10, the building 910 is illustrated as it may appear when deflected during a seismic event. This seismic event includes lateral ground shift, illustrated on FIG. 10 by arrow 934. On the other hand, the lateral ground shift 934 results in an inertia reaction or force 936 acting on the building, principally at the floors or beams 918-924. The inertia force is illustrated in FIG. 10 by arrows 936 at each floor of the building. As a result of the seismic event and the inertia force, the building is distorted as is shown in FIG. 10.

Comparing FIGS. 9 and 10, it will be seen that the shear panels 926*a-d* have not distorted significantly as a result of the seismic event, but that the foundation and beams 918-924 are each displaced laterally relative to the adjacent one of the plural shear panels 926*a-d*. As a result, each of the seismic energy dampers 932 is able to absorb and dissipate seismic energy from the seismic lateral ground shift 934. Considering FIGS. 9 and 10, it is to be noted that the seismic energy dampers are arrayed or distributed within the structure of the building 910. Thus, the absorption and dissipation of seismic energy is also distributed within the building structure, avoiding stress concentrations which might result from conventional seismic damping technology. As a result, the swaying or excursions of movement experienced by the building at each floor is markedly reduced from what would be the case where the seismic energy dampers and shear panels not present in the building structure. Consequently, damage to the building 910 from the seismic event 934 is significantly controlled.

Turning now to FIG. 11, an alternative embodiment of a shear panel structure, attaching to plural seismic energy dampers, and also attaching to the column and beam structure of a building is illustrated. The columns 1014/1016 and beams 1018, 1020 may be considered to be substantially the same as was illustrated in FIGS. 9 and 10. Moreover, in the embodiment of FIG. 11, the shear panel 938 is made of pre-cast, reinforced concrete, as will be further described. Alternatively, the shear panels 938 may be made of post-tensioned concrete. In essence, the plural seismic energy dampers 940 may each be substantially like that illustrated in FIGS. 1, 2, 6, or 8. However, FIG. 11 illustrates that the shear panel 938 is also connected to and constrained by the columns 1014/1016. In order to connect the shear panels 938 to the columns 1014/1016, so as to resist an inherent moment occurring in the plane of each shear panel as a result of seismic displacements, illustrated on FIG. 11 by the circular arrow 942 (the double-headed arrow indicating that this moment may have either a clock-wise or counter clock-wise direction), the panel 938 also carries plural guide members 944. At a particular time the moment 942 will have only a single direction, but because the building may sway back and forth, the direction of the moment 942 may reverse depending on the direction of relative movement of the shear panels 938 and building structure. It will be noted viewing FIG. 11, that were the moment 942 not countered, then the seismic dampers near one corner of the panel 938 would be subject to an additional normal force, while those near the opposite corner of the panel would experience a reduced normal force. The result would be an undesirably uneven distribution of seismic energy damping among the plural dampers associated with each shear panel. However, as will be seen, countering the moment 942 reduces the overturning shear demand at the ends of the beams.

FIG. 12 illustrates that in order to overcome the effect of the moment 942, each of the plural guide members 944 includes a substantially rigid guide rod 946 secured in a socket 948 carried in a respective one of the columns 1014, 1016. This guide rod 946 is movably received in a guide spool 950 rigidly attached to the shear panel 938. As a result, relative movements of the shear panel 938 and column 1014/1016 are permitted in the direction parallel to arrow 952 on FIG. 12. However, relative movements of the shear panel 938 and column 1014/1016 in the direction of arrow 954 are resisted by interaction of the guide rod 946 in socket 948. In other words, relative movements along the arrow 954 create bending moments in the guide rod 946, which are resisted by the substantial rigidity of this guide rod.

Turning now to FIG. 13, a fragmentary cross sectional view in the plane of the shear panels 938 is provided. As is seen in FIGS. 11 and 13, the shear panels define plural outwardly extending round holes 956 (arrowed on FIG. 11), each opening at one end on an edge surface of the shear panel 938. These holes 956 each open at an opposite end in a respective niche 960 opening on a face of the shear panel 938. Each of the holes 956 of the shear panel 938 receives a spool assembly 826 (which will be familiar from the description above), as does each of plural holes 958 defined by the beams 1018, 1020. The holes 956 and 958 generally align with one another within construction tolerances, so that tie bolts 822 can connect the spool assemblies 826, as will be well understood at this point of the disclosure. A friction member 842 interposed between the friction faces or surfaces of each spool assembly 826 provides for selection of the Coulomb damping characteristic to apply between the shear panel 938 and the beams 1018, 1020. As can be appreciated by viewing FIG. 13, the plural niches of the shear panels 938 provide for tightening of the tie bolts 822. In view of this description, it will be understood that the seismic dampers of FIGS. 9-13 operate as described above. However, an improved uniformity of the distribution of seismic energy absorption and dissipation is afforded by the action of the guide members 944 in resisting the overturning moment 942 inherent in the building and seismic damper structure as depicted.

Those skilled in the art will further appreciate that the present invention may be embodied in other specific forms without departing from the spirit or central attributes thereof. Because the foregoing description of the present invention discloses only particularly preferred exemplary embodiments of the invention, it is to be understood that other variations are recognized as being within the scope of the present invention. Accordingly, the present invention is not limited to the particular embodiments which have been described in detail herein. Rather, reference should be made to the appended claims to define the scope and content of the present invention.

I claim:

1. A seismic energy damping apparatus for a building structure, said apparatus comprising:

a pair of building structure members juxtaposed to one another, said building structure members being substantially immovable relative to one another in the absence of seismic energy delivered to said building by a seismic event, and being subject to relative lateral movement during a seismic event, each of the pair of building structure members defining a respective one of a pair of holes generally aligned with one another;

a pair of friction washers each connected to a respective one of said pair of building structure members, said pair of friction washers confronting one another and defining respective friction surfaces;

said pair of friction surfaces cooperating with one another and moving relative to one another during a seismic event to frictionally dissipate seismic energy;

a resilient tie bolt extending through said aligned pair of holes and urging the pair of building structure members and said pair of friction surfaces toward one another with a determined force, thus to substantially determine the frictional damping force effective between said pair of building structure members and said pair of friction washers connected thereon; and said pair of holes being oversized with respect to said tie bolt thus to provide room for said building structure members to move laterally relative to one another during the seismic event without binding on said tie bolt;

wherein one of said pair of friction washers is defined by an annular flange portion of a flanged tubular member received in a respective hole defined by one of said building structure members.

2. The seismic energy damper of claim 1, wherein at least one of said pair of friction washers is formed of steel.

3. The seismic energy damper of claim 1, wherein both of said pair of friction washers are formed of steel.

4. The seismic energy damper of claim 3, further including a comparatively thin friction member interposed between and frictionally engaging with each of said pair of friction washers.

5. The seismic energy damper of claim 4, wherein said friction member is formed of brass.

6. The seismic energy damper of claim 1, further including a thickness of viscoelastic material interposed between a respective one of said building structure members and the respective one of said friction washers carried by said one building structure member, said viscoelastic material at one side of said thickness being secured substantially immovably relative to said one building structure member and at an opposite side of said thickness being secured substantially immovably to said friction washer, whereby said viscoelastic material allows relative movements of said pair of building structure members even without frictional sliding of said friction surfaces, but with viscous dissipation of seismic energy.

7. The seismic energy damper of claim 1, wherein said hole of one of said pair of building structure members is a though hole, and said flanged tubular member is defined by a spool assembly fixedly attached through the respective hole of said one of said building structure members.

8. The seismic energy damper of claim 7, wherein said spool assembly includes another flanged tubular body defining another flange disposed adjacent an opposite side of said building structure member from said friction washer, and said flanged tubular member and said another flanged tubular member being fixedly connected to one another in engagement with said building structure member.

9. The seismic energy damper of claim 8, wherein said flanged tubular member and said another flanged tubular member threadably connect fixedly to one another, thus to threadably clamp though said through hole on said building structure member.

10. The seismic energy damper of claim 1, wherein said hole of one of said pair of building structure members is a blind hole or cavity, and said flanged tubular member is defined by a spool assembly fixedly attached within said blind hole or cavity.

11. A seismic energy damping apparatus, said apparatus comprising:

a pair of structure members juxtaposed to one another, and subject to relative movement during a seismic event, each of the pair of structure members defining a respective one of a pair of holes generally aligned with one another;

a pair of friction washers each connected to a respective one of said pair of structure members, said pair of friction washers confronting one another and defining respective friction surfaces;

said pair of friction surfaces cooperating with one another and moving relative to one another during a seismic event to frictionally dissipate seismic energy;

a resilient tie bolt extending through said aligned pair of holes and urging the pair of structure members and said pair of friction surfaces toward one another with a determined force, thus to substantially determine the frictional damping force effective between said pair of structure members and said pair of friction washers connected thereon; and said pair of holes being oversized with respect to said tie bolt thus to provide room for said structure members to move relative to one another during the seismic event without binding on said tie bolt.

wherein at least one of said pair of friction washers is defined by an annular flange portion of a flanged tubular member received in a respective hole defined by one of said structure members;

further including a sleeve member formed of viscoelastic material interposed between said flanged tubular member and said one structure member, said viscoelastic material at an inside diameter of said sleeve member being secured substantially immovably relative to said flanged tubular member and at an outer diameter of said sleeve member said viscoelastic material being secured substantially immovably to said structure member, whereby said viscoelastic material allows relative movements of said structure member and said flanged tubular member with viscous dissipation of seismic energy.

12. A seismic energy damping apparatus, said apparatus comprising:

a pair of structure members juxtaposed to one another, and subject to relative movement during a seismic event, each of the pair of structure members defining a respective one of a pair of holes generally aligned with one another;

a pair of friction washers each connected to a respective one of said pair of structure members, said pair of friction washers confronting one another and defining respective friction surfaces;

said pair of friction surfaces cooperating with one another and moving relative to one another during a seismic event to frictionally dissipate seismic energy;

a resilient tie bolt extending through said aligned pair of holes and urging the pair of structure members and said pair of friction surfaces toward one another with a determined force, thus to substantially determine the frictional damping force effective between said pair of structure members and said pair of friction washers connected thereon; and said pair of holes being oversized with respect to said tie bolt thus to provide room for said structure members to move relative to one another during the seismic event without binding on said tie bolt;

wherein at least one of said pair of friction washers is defined by an annular flange portion of a flanged tubular member received in a respective hole defined by one of said structure members;

wherein said hole of one of said pair of structure members is a blind hole or cavity, and said flanged tubular member is defined by a spool assembly fixedly attached within said blind hole or cavity;

wherein said spool assembly includes a projecting flange fixedly attached to said flanged tubular member opposite to said friction washer, and said projecting flange being embedded into said structure member.

13. A seismic energy damping apparatus, said apparatus comprising:

a pair of structure members juxtaposed to one another, and subject to relative movement during a seismic event, each of the pair of structure members defining a respective one of a pair of holes generally aligned with one another;

a pair of friction washers each connected to a respective one of said pair of structure members, said pair of friction washers confronting one another and defining respective friction surfaces;

said pair of friction surfaces cooperating with one another and moving relative to one another during a seismic event to frictionally dissipate seismic energy;

a resilient tie bolt extending through said aligned pair of holes and urging the pair of structure members and said pair of friction surfaces toward one another with a determined force, thus to substantially determine the frictional damping force effective between said pair of structure members and said pair of friction washers connected thereon; and said pair of holes being oversized with respect to said tie bolt thus to provide room for said structure members to move relative to one another during the seismic event without binding on said tie bolt;

wherein at least one of said pair of friction washers is defined by an annular flange portion of a flanged tubular member received in a respective hole defined by one of said structure members;

wherein said hole of one of said pair of structure members is a blind hole or cavity, and said flanged tubular member is defined by a spool assembly fixedly attached within said blind hole or cavity;

wherein said friction washer defines plural countersunk bolt holes, and said flanged tubular body is fixedly attached to said structure member by plural fasteners penetrating said bolt holes and engaging into said structure member.

14. The seismic energy damper of claim 13, wherein said tie bolt carries a heavy washer engaging one of said building structure members.

15. The seismic energy damper of claim 14, wherein said tie bolt further carries a Belleville washer providing increased resilience to said tie bolt.

16. A seismic energy damping apparatus for a building structure, said apparatus comprising:

a pair of building members which are immovable relative to one another in the absence of seismic energy input to said building structure, and said pair of building members being subject to relative lateral motion during a seismic event, said pair of building members being disposed adjacent to one another, and each of said pair of building members defining a respective one of a pair of holes generally aligned with one another;

at least one of said pair of building members carrying a first element defining a first friction surface disposed toward the other of said pair of building members, the other of said pair of building members carrying a second element defining a second friction surface disposed toward said first friction surface;

a thin friction control and damping element interposed between said first and second friction surfaces;

an elongate resilient tie rod member extending in said pair of holes with radial clearance accommodating said relative lateral motion of said pair of building members during a seismic event, and said elongate resilient tie rod member biasing said pair of building members forcefully toward one another to engage said first and said second friction surfaces frictionally and movably with said interposed friction control and damping element;

wherein at least one of said first and said second element is defined by a spool assembly carried by one of said pair of building members, and said friction surface being defined by a flange portion of said spool assembly.

17. The seismic energy damper of claim 16, further including a comparatively thin friction member interposed between and frictionally engaging with each of said pair of friction surfaces.

18. The seismic energy damper of claim 16, wherein said spool assembly includes another flanged tubular body defining another flange disposed adjacent an opposite side of said pair of building members, and said flanged tubular member and said another flanged tubular member being fixedly connected to one another in engagement with said one of said pair of building members.

19. The seismic energy damper of claim 16, wherein said hole of one of said pair of building members is a blind hole or cavity, and said spool assembly is fixedly attached within said blind hole or cavity.

20. The seismic energy damper of claim 16 further including a thickness of viscoelastic material secured at one side of said thickness to said one building member, and secured at an opposite side of said thickness relative to said friction surface, so that said friction surface is able to move relative to said one building member with dissipation of seismic energy.

21. A method of absorbing and dissipating seismic energy delivered to a building structure during a seismic event, said method comprising steps of:

juxtaposing to one another a pair of building structure members which are subject to relative lateral movement during a seismic event;

providing for each of the pair of building structure members to define a respective one of a pair of holes generally aligned with one another;

providing a pair of friction washers each connected substantially immovably to a respective one of said pair of building structure members;

arranging said pair of friction washers to confront one another, and employing said pair of friction washers to define respective friction surfaces;

providing for least one of said pair of friction washers to be defined by a flange portion of a spool assembly carried by one of said pair of building structure members;

providing for said pair of friction surfaces to frictionally cooperate with one another and to moving relative to one another during a seismic event to frictionally dissipate seismic energy;

providing a resilient tie bolt extending through said aligned pair of holes and urging the pair of building structure members and said pair of friction surfaces toward one another with a determined force, thus to substantially determine a frictional damping force effective between said pair of building structure members and said pair of friction washers connected thereon; and configuring said pair of holes to be oversized with respect to said tie bolt thus to provide room for said building structure members to move laterally relative to one another during the seismic event without binding on said tie bolt.

* * * * *